US005620941A

United States Patent [19]

Van Hanehem et al.

[11] Patent Number: 5,620,941

[45] Date of Patent: Apr. 15, 1997

[54] STABILIZERS FOR DYE-DONOR ELEMENT USED IN THERMAL DYE TRANSFER

[75] Inventors: Richard C. Van Hanehem, Rochester; James P. Muehlbauer, North Chili, both of N.Y.

[73] Assignee: Eastman Kodak Company, Rochester, N.Y.

[21] Appl. No.: 632,818

[22] Filed: Apr. 16, 1996

[51] Int. Cl.[6] ..... B41M 5/035; B41M 5/38

[52] U.S. Cl. ..... 503/227; 428/195; 428/913; 428/914

[58] Field of Search ..... 8/471; 428/195, 428/913, 914; 503/227

[56] References Cited

U.S. PATENT DOCUMENTS 3,868,252 2/1975 Campbell et al. ..... 96/3

4,695,287 9/1987 Evans et al. ..... 8/471

*Primary Examiner*—B. Hamilton Hess

*Attorney, Agent, or Firm*—Harold E. Cole

[57] ABSTRACT

This invention relates to a dye-donor element for thermal dye transfer comprising a support having thereon a dye layer comprising a naphthol-p-phenylenediamine cyan dye in a polymeric binder, the dye layer also containing a stabilizer, the stabilizer comprising a compound containing a nitroxyl free radical and having a molecular weight of at least about 400 or a hydroxylamine moiety and having a molecular weight of at least about 330, the stabilizer being present in the amount of 5-10 mole % based on the weight of the dye.

18 Claims, No Drawings

STABILIZERS FOR DYE-DONOR ELEMENT USED IN THERMAL DYE TRANSFER

This invention relates to the use of certain stabilizers in dye-donor elements for thermal dye transfer systems, and more particularly to stabilizers for p-phenylenediamine cyan dyes in such elements.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta or yellow signal. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

An important requirement for any thermal dye-donor element is to maintain performance over its useful lifetime without degradation in the quality of the image. The dye layer of a dye-donor element for resistive head thermal dye transfer generally comprises a polymeric binder and diffusible dyes. The percentage of dye in the layer is typically quite high, in the range of 20 to 80%. The dye is usually dissolved in the binder or phase-separated into small domains. During keeping of the donor, the temperature and humidity may be elevated and the dye layer is in contact with a slipping layer coated on the back side of the donor element when it is wound up in spool form. The slipping layer may contain mobile lubricating oils or materials which can act as plasticizers or solvents for the dye layer. This enables the dye to become mobile, allowing changes to occur in the layer including further phase separation, migration of the dye to the surface, and even crystallization of the dye. Dye may also transfer to the slipping layer.

U.S. Pat. No. 4,695,287 relates to dye-donor elements for thermal dye transfer containing a p-phenylenediamine cyan dye. There is a problem with these elements is that the p-phenylenediamine cyan dye may be subject to degradation during storage, when the dye layer comes into contact with humidity from the atmosphere or when the elements are stored at elevated temperatures.

U.S. Pat. No. 3,868,252 relates to the use of nitroxyl-containing polymers as oxidants in a silver halide-based color diffusion transfer process. However, there is no disclosure that such polymers are useful in a dye-donor element to improve raw stock keeping performance.

It is an object of this invention to provide addenda for the dye layer of a thermal dye-donor element to assure stabilization of a naphthol-p-phenylenediamine cyan dye present.

This and other objects are achieved in accordance with this invention which relates to a dye-donor element for thermal dye transfer comprising a support having thereon a dye layer comprising a naphthol-p-phenylenediamine cyan dye in a polymeric binder, the dye layer also containing a stabilizer, the stabilizer comprising a compound containing a nitroxyl free radical and having a molecular weight of at least about 400 or a hydroxylamine moiety and having a molecular weight of at least about 330, the stabilizer being present in the amount of 5–10 mole % based on the weight of the dye.

By use of the stabilizers of the invention, dye degradation of a dye-donor element during raw stock keeping is minimized.

Nitroxyl-free radical compounds useful in the invention can comprise, for example,

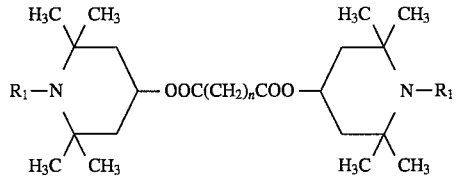

wherein $R_1$=O. or OH and n is from 1 to about 15.

In a preferred embodiment of the invention, n in the above compound is 8 and the compound has the following structure:

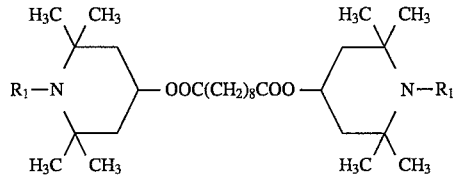

Compound 1

This compound is made using Tinuvin 770® from Ciba-Geigy as a starting material and modifying it by the procedure described in J.Phys.Chem., 97, 1138 (1993), to create the free radical.

Compounds containing a hydroxylamine moiety useful in the invention can comprise, for example:

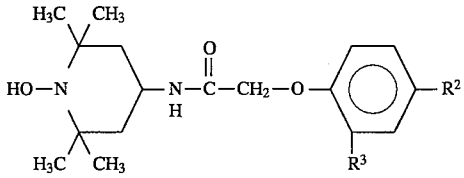

wherein $R^2$ and $R^3$ each independently represents an alkyl group of from about 1 to about 15 carbon atoms.

In another preferred embodiment of the invention, in the above formula, both $R^2$ and $R^3$ are t-$C_5H_{11}$ which would result in the following structure:

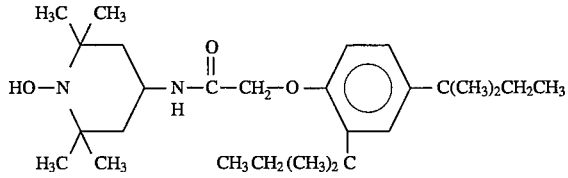

Compound 2

Any naphthol-p-phenylenediamine cyan dye can be used in the dye-donor employed in the invention provided it is transferable to the dye-receiving layer by the action of heat.

Examples of such dyes include

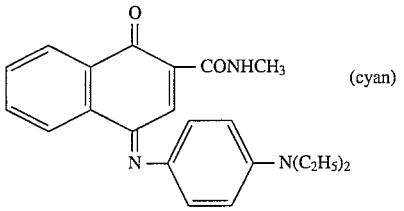

Cyan Dye C-1 (cyan)

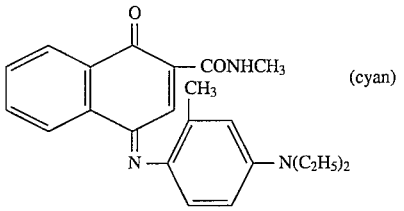

Cyan Dye C-2 (cyan)

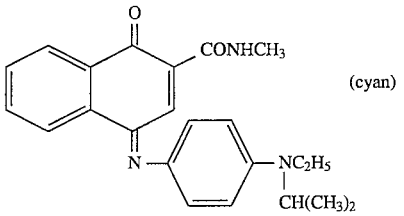

Cyan Dye C-3 (cyan)

The above dyes may be employed singly or in combination. The dyes may be used at a coverage of from about 0.05 to about 1 g/m$^2$ and are preferably hydrophobic.

A dye-barrier layer may be employed in the dye-donor elements of the invention to improve the density of the transferred dye. Such dye-barrier layer materials include hydrophilic materials such as those described and claimed in U.S. Pat. No. 4,716,144.

The dye layer of the dye-donor element may be coated on the support or printed thereon by a printing technique such as a gravure process.

Any material can be used as the support for the dye-donor element of the invention provided it is dimensionally stable and can withstand the heat of the thermal head. Such materials include polyesters such as poly(ethylene terephthalate); polyamides; polycarbonates; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 to about 200 μm. It may also be coated with a subbing layer, if desired, such as those materials described in U.S. Pat. No. 4,695,288 or 4,737,486.

The dye in the dye-donor element of the invention is dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207; a polycarbonate; polyvinyl acetate, poly(styrene-co-acrylonitrile), a poly(sulfone) or a poly(phenylene oxide). The binder may be used at a coverage of from about 0.1 to about 5 g/m$^2$.

The reverse side of the dye-donor element may be coated with a slipping layer to prevent the printing head from sticking to the dye-donor element. Such a slipping layer would comprise either a solid or liquid lubricating material or mixtures thereof, with or without a polymeric binder or a surface active agent. Preferred lubricating materials include oils or semi-crystalline organic solids that melt below 100° C. such as poly(vinyl stearate), beeswax, perfluorinated alkyl ester polyethers, poly(caprolactone), silicone oil, poly(tetrafluoroethylene), carbowax, poly(ethylene glycols), or any of those materials disclosed in U.S. Pat. Nos. 4,717,711; 4,717,712; 4,737,485; and 4,738,950. Suitable polymeric binders for the slipping layer include poly (vinyl alcohol-co-butyral), poly (vinyl alcohol-co-acetal), poly(styrene), poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.05 to 50 weight %, preferably 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal or a poly(ethylene terephthalate). The support for the dye-receiving element may also be reflective such as baryta-coated paper, polyethylene-coated paper, an ivory paper, a condenser paper or a synthetic paper such as DuPont Tyvek®. Pigmented supports such as white polyester (transparent polyester with white pigment incorporated therein) may also be used.

The dye image-receiving layer may comprise, for example, a polycarbonate, a polyurethane, a polyester, polyvinyl chloride, poly(styrene-co-acrylonitrile), poly(caprolactone), a poly(vinyl acetal) such as poly(vinyl alcohol-co-butyral), poly(vinyl alcohol-co-benzal), poly(vinyl alcohol-co-acetal) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have alternating areas of dyes such as sublimable cyan and/or magenta and/or yellow and/or black or other dyes. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of cyan, yellow and magenta, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040MCSOO1), a TDK Thermal Head F415 HH7-1089 or a Rohm Thermal Head KE 2008-F3.

A thermal dye transfer assemblage of the invention comprises a) a dye-donor element as described above, and b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed three times using different dye-donor elements. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

The following control stabilizer materials were used in the experimental work:

Control 1

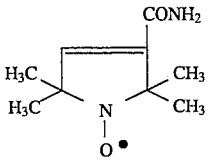

3-carbamoyl-2,2,5,5-tetramethyl-3-pyrrolin-1-yloxy

Control 2

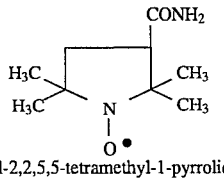

3-carbamoyl-2,2,5,5-tetramethyl-1-pyrrolidin-1-yloxy

Control 3

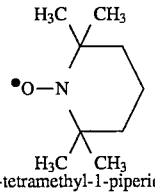

2,2,6,6-tetramethyl-1-piperidinoxyl

Control 4

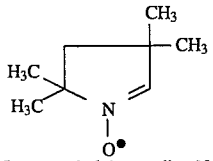

3,3,5,5-tetramethyl-1-pyrroline-N-oxide

Control 5

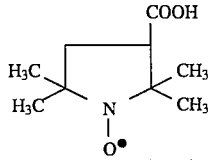

2,2,5,5-tetramethyl-1-pyrrolidinyloxy-3-carboxylic acid

-continued

Control 6

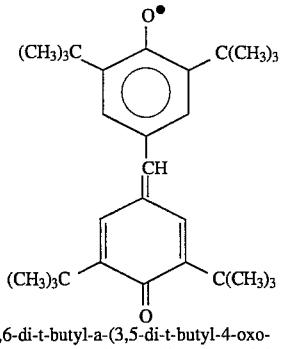

2,6-di-t-butyl-a-(3,5-di-t-butyl-4-oxo-2,5-cyclohexadien-1-ylidene)-p-tolyloxy

Control 7

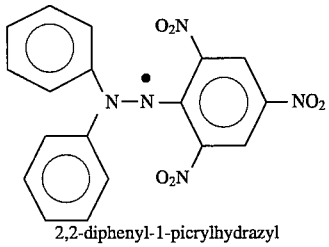

2,2-diphenyl-1-picrylhydrazyl

Control 8

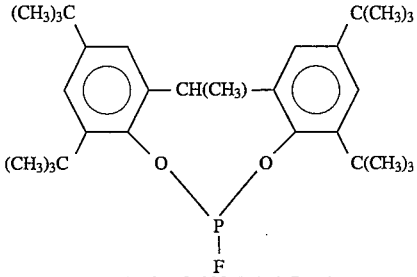

ETHANOX ® 398 (Ethyl Corp.)

Control 9

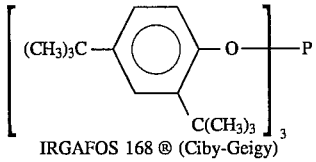

IRGAFOS 168 ® (Ciby-Geigy)

Control 10

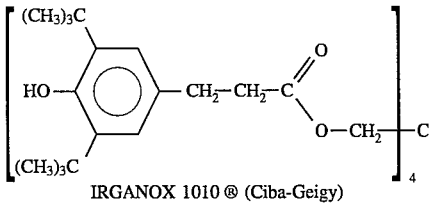

IRGANOX 1010 ® (Ciba-Geigy)

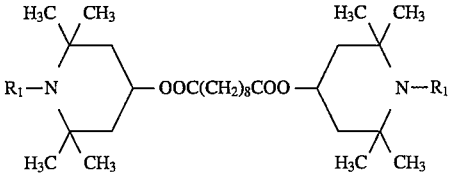

$R_1$ = H, Tinuvin 770 ® (Ciba-Geigy) Control 11, $R_1$ = $OC_8H_{17}$, Tinuvin 123 ® (Ciba-Geigy) Control 12, -continued

| | |
|---|---|
| 2,4,6-tri-t-butyl phenol | Control 13: |
| t-butyl hydroquinone | Control 14: |

Cyan dye donor samples for incubation testing were prepared by coating onto an unsubbed 100 μm poly(ethylene terephthalate) support a dye layer containing 0.27 g/m$^2$ of cyan dye C-1 above and various addenda to be tested in the amounts indicated in Table 1, in a cellulose acetate propionate binder (2.5% acetyl, 45% propionyl) from a toluene, methanol, cyclopentanone (70:25:5 wt-ratio) solvent mixture.

These samples were incubated against bare Estar® (Eastman Chemical Co.) for six weeks at 60° C./50% RH. Samples of each were also stored at 0° C. as a check condition. After incubation, each sample was analyzed by high performance liquid chromatography (HPLC) to determine the change in cyan dye coverage. The cyan dye concentration was determined from external standards and converted to dye coverage. The amount of dye remaining for each sample was normalized against the result for Compound 1 in each case at 5 mole %. (Compound 1 was thus 1.0, meaning that there was no dye degradation). A relative ranking for dye stability as compared to Compound 1 for each sample was thus obtained as follows:

TABLE 1

| Stabilizer | Coverage of Addendum (mole % of Dye) | Molecular Weight of Addendum | Relative Ranking for Dye Stability |
|---|---|---|---|
| None | 0 | — | 0.42 |
| Compound 1 | 1 | 510 | 0.56 |
| Compound 1 | 5 | 510 | 1.00 |
| Compound 1 | 10 | 510 | 1.01 |
| Control 3 | 10 | 156 | 0.57 |
| Control 11 | 10 | 480 | 0.32 |

The above results show that Compound 1 is effective at levels from about 5 to 10 mole % with respect to the dye content. A lower molecular weight nitroxyl analog, Control 3, as well as the free amine Control 11 were found to be ineffective, even when used at levels of 10 mole %.

EXAMPLE 2

This example was similar to Example 1 to show compounds of the invention compared to various other types of free radical compounds, including nitroxyl, hydrazyl, and galvinoxyl free radical-carrying compounds. The stabilizers were all used at 5 mole % of dye. The following results were obtained:

TABLE 2

| Stabilizer | Molecular Weight (g/mole) | Type of Compound | Relative Ranking for Dye Stability |
|---|---|---|---|
| None | — | — | 0.34 |
| Compound 1 | 510 | nitroxyl | 1.00 |
| Compound 2 | 446 | hydroxylamine | 0.74 |
| Control 5 | 186 | nitroxyl | 0.38 |
| Control 4 | 141 | nitroxyl | 0.46 |
| Control 2 | 185 | nitroxyl | 0.44 |
| Control 1 | 183 | nitroxyl | 0.49 |
| Control 6 | 422 | carboxyl | 0.41 |
| Control 7 | 394 | hydrazyl | 0.40 |

The above results show that, when compared against other types of free radical carriers, the compounds of the invention are superior in their dye stabilization effectiveness.

EXAMPLE 3

This example was similar to Example 2 to show compounds of the invention compared to various other commonly used antioxidants or stabilizers. The following results were obtained:

TABLE 3

| Stabilizer | Relative Ranking for Dye Stability |
|---|---|
| None | 0.54 |
| Compound 1 | 1.00 |
| Control 3 | 0.47 |
| Control 13 | 0.40 |
| Control 11 | 0.46 |
| Control 12 | 0.44 |
| Control 10 | 0.49 |
| Control 8 | 0.47 |
| Control 9 | 0.44 |
| Control 14 | 0.42 |

The above results show that, when compared against other types of free radical carriers, the compounds of the invention are superior in their dye stabilization effectiveness.

The invention has been described in detail with particular reference to preferred embodiments thereof, but it will be understood that variations and modifications can be effected within the spirit and scope of the invention.

What is claimed is:

1. A dye-donor element for thermal dye transfer comprising a support having thereon a dye layer comprising a naphthol-p-phenylenediamine cyan dye in a polymeric binder, said dye layer also containing a stabilizer, said stabilizer comprising a compound containing a nitroxyl free radical and having a molecular weight of at least about 400 or a hydroxylamine moiety and having a molecular weight of at least about 330, said stabilizer being present in the amount of 5–10 mole % based on the weight of the dye.

2. The element of claim 1 wherein said stabilizer is

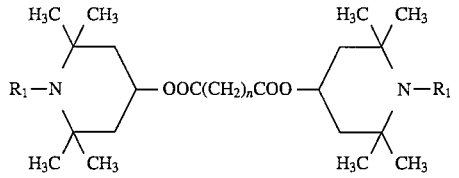

wherein $R_1$=O. and n is from 1 to about 15.

3. The element of claim 2 wherein n is 8.

4. The element of claim 1 wherein said stabilizer is

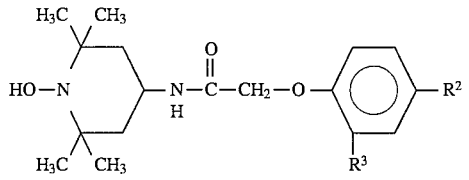

wherein $R^2$ and $R^3$ each independently represents an alkyl group of from about 1 to about 15 carbon atoms.

5. The element of claim 4 wherein both $R^2$ and $R^3$ are t-$C_5H_{11}$.

6. The element of claim 1 wherein the side of the support opposite the side containing said dye layer has a slipping layer thereon.

7. A process of forming a thermal dye transfer image comprising:

a) contacting at least one dye-donor element comprising a support having thereon a dye layer comprising an image dye in a polymeric binder, with a dye-receiving element comprising a support having thereon a polymeric dye image-receiving layer;

b) imagewise-heating said dye-donor element; and c) transferring a dye image to said dye-receiving element to form said thermal dye transfer image, said dye layer also containing a stabilizer comprising a compound containing a nitroxyl free radical and having a molecular weight of at least about 400 or a hydroxylamine moiety and having a molecular weight of at least about 330, said stabilizer being present in the amount of 5–10 mole % based on the weight of the dye.

8. The process of claim 7 wherein said stabilizer is

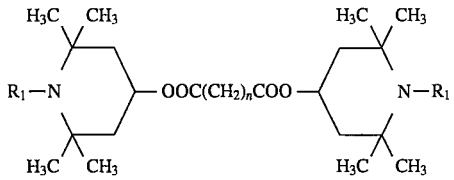

wherein $R_1$=O. and n is from 1 to about 15.

9. The process of claim 8 wherein n is 8.

10. The process of claim 7 wherein said stabilizer is

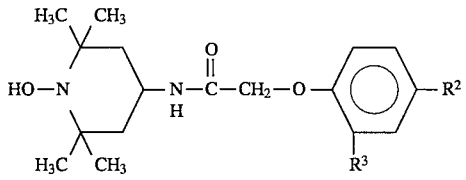

wherein $R^2$ and $R^3$ each independently represents an alkyl group of from about 1 to about 15 carbon atoms.

11. The process of claim 10 wherein both $R^2$ and $R^3$ are t-$C_5H_{11}$.

12. The process of claim 7 wherein the side of the support opposite the side containing said dye layer has a slipping layer thereon.

13. A thermal dye transfer assemblage comprising:

(a) a dye donor element comprising a support having thereon a dye layer comprising an image dye dispersed in a polymeric binder, and (b) a dye-receiving element comprising a support having thereon a dye image-receiving layer, said dye-receiving element being in superposed relationship with said dye-donor element so that said dye layer is in contact with said dye image-receiving layer, wherein said dye layer also contains a stabilizer comprising a compound containing a nitroxyl free radical and having a molecular weight of at least about 400 or a hydroxylamine moiety and having a molecular weight of at least about 330, said stabilizer being present in the amount of 5–10 mole % based on the weight of the dye.

14. The assemblage of claim 13 wherein said stabilizer is

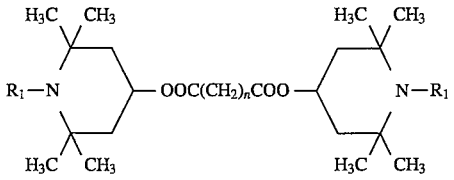

wherein $R_1$=O. and n is from 1 to about 15.

15. The assemblage of claim 14 wherein n is 8.

16. The assemblage of claim 13 wherein said stabilizer is

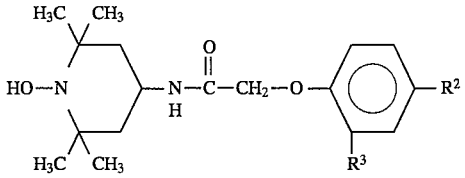

wherein $R^2$ and $R^3$ each independently represents an alkyl group of from about 1 to about 15 carbon atoms.

17. The assemblage of claim 16 wherein both $R^2$ and $R^3$ are t-$C_5H_{11}$.

18. The assemblage of claim 13 wherein the side of the support opposite the side containing said dye layer has a slipping layer thereon.

* * * * *

UNITED STATES PATENT AND TRADEMARK OFFICE

CERTIFICATE OF CORRECTION

PATENT NO. : 5,620,941

DATED : April 15, 1997

INVENTOR(S) : Richard C. Van Hanehem and James P. Muehlbauer

It is certified that error appears in the above-indentified patent and that said Letters Patent is hereby corrected as shown below:

On the title page, after item [22], insert
--Related U.S. Application Data
[63] Provisional Application Serial No. 60/002,979, filed August 30, 1995.--

In Column 1, line 3, insert
--CROSS REFERENCE TO RELATED APPLICATION
Reference is made to and priority claimed from U.S. Provisional Application Serial No. US 60/002,979, filed 30 August 1995, entitled STABILIZERS FOR DYE-DONOR ELEMENT USED IN THERMAL DYE TRANSFER--.

Signed and Sealed this

Fifteenth Day of July, 1997

*Attest:*

*Attesting Officer*

Bruce Lehman

BRUCE LEHMAN

*Commissioner of Patents and Trademarks*